US006086347A

United States Patent [19]

Ryska et al.

[11] Patent Number: 6,086,347

[45] Date of Patent: Jul. 11, 2000

[54] TWO-STAGE ROTARY VANE MOTOR

[75] Inventors: Antonin Ryska; Jiri Ota, both of Praha, Czech Rep.; Herman H. Viegas, Bloomington; Bruce E. McClellan, Richfield, both of Minn.

[73] Assignee: Thermo King Corporation, Minneapolis, Minn.

[21] Appl. No.: 09/139,184

[22] Filed: Aug. 25, 1998

[51] Int. Cl.[7] ..... F01C 11/00

[52] U.S. Cl. ..... 418/212; 418/69

[58] Field of Search ..... 418/212, 69

[56] References Cited

U.S. PATENT DOCUMENTS

| | | | |
|---|---|---|---|
| 558,144 | 4/1896 | Berr | 418/212 |
| 811,117 | 1/1906 | Andrews | 418/212 |
| 877,872 | 1/1908 | Srnec | 418/212 |
| 1,104,331 | 7/1914 | Tree | 418/212 |
| 1,187,462 | 6/1916 | Martin | 418/212 |
| 1,220,244 | 3/1917 | Hindley et al. | 418/212 |
| 2,208,177 | 6/1940 | Barrett | 418/212 |
| 3,588,297 | 6/1971 | Crump | 418/212 |
| 3,918,137 | 11/1975 | Telang et al. | 418/178 |
| 4,319,551 | 3/1982 | Rubinshtein | 418/35 |

*Primary Examiner*—Thomas Denion
*Assistant Examiner*—Theresa Trieu
*Attorney, Agent, or Firm*—Michael M. Gnibus

[57] ABSTRACT

A two-stage rotary vane motor is provided that is particularly efficient for use in cryogenic refrigeration systems where the mass flow rate of the drive fluid (which may be expanding cryogen gas) varies substantially. The two-stage rotary vane motor includes a housing enclosure having first and second fluid chambers, each with their own inlets for receiving pressurized cryogen, and first and second rotors rotatably mounted within the chambers by means of a shaft assembly having an output end. In operation, when the mass flow of the drive fluid is high (350 pounds per hour), fluid is admitted through the inlets of both the chambers of the housing enclosure to drive both of the rotors. However, when the mass flow of the drive fluid drops to a low level (i.e., 100 pounds per hour), expanding cryogen is admitted only through the second chamber of the housing enclosure to drive only the second rotor. An overrunning clutch may be used to engage and disengage the first rotor from the shaft assembly in coordination with the admission of drive fluid through both or only one of the housing inlets.

1 Claim, 6 Drawing Sheets

TWO-STAGE ROTARY VANE MOTOR

BACKGROUND OF THE INVENTION

This invention generally relates to rotary vane motors, and is specifically concerned with a two-stage rotary vane motor for effectively extracting mechanical energy from a variable flow of an expanding cryogenic gas.

Rotary vane motors are well known in the prior art. Such motors (sometimes known as "expanders") typically comprise a housing having a cylindrical interior, and a rotor eccentrically mounted therein. The rotor includes a cylindrically shaped body having a plurality of uniformly spaced, radially oriented slots for slidably receiving a plurality of rectangularly shaped vanes. Both the housing and the rotor body within the cylindrical enclosure defined by the housing leaves a gap between the rotor and the housing that is crescent-shaped in cross section. In operation, pressurized drive fluid (usually compressed air) is admitted in an inlet port in the housing located at one of the narrow ends of the crescent-shaped gap. The pressurized fluid pushes against the trailing faces of the slidable vanes, thereby rotating the rotor body. Centrifugal force radially slings the vanes out of their slots such that their outer edges sealingly engage the surface of the cylindrical enclosure. The vanes reciprocate in their respective slots as their outer edges sealingly and slidably engage the interior surface defining the cylindrical enclosure. The pressurized fluid is expelled out an outlet port located at the other end of the crescent-shaped gap in order to create the pressure differential necessary to drive the rotor assembly.

Such prior art rotary vane motors are well adapted for powering tools such as pneumatic wrenches and grinders where the operating speeds of the motor shaft are greater than 2000 rpm, and where a steady mass flow rate of pressurized drive fluid in the form of a supply of compressed and lubricant-containing air is consistently supplied by the shop air compressor. The applicants have observed, however, that such prior art rotary vane motor designs are not well suited for use at relatively low rotational speeds (i.e., under 1500 rpms) where the mass flow rate of the drive fluid substantially varies. Such an application for a low speed rotary vane motor may occur, for example, in a cryogenic refrigeration system powered by a tank of liquefied carbon dioxide such as that disclosed in co-pending U.S. Ser. No. 08/501,372 filed Jul. 12, 1995, also assigned to the Thermo King Corporation of Minneapolis, Minn. In such an application, the rotary vane motor is used to drive an evaporator blower and an alternator to recharge the battery that powers the refrigeration control system, and low rotational speeds are preferred to enhance the efficiency of the evaporator blower.

At low rotational speeds, in order for the rotary vane motor to efficiently convert the energy of the expanding gas into rotary energy, the components which comprise the rotor assembly must be properly sized. If the overall mass flow rate of the expanding cryogen remained constant during the operation of such refrigeration systems, proper sizing of the rotor assembly components would not be a critical issue. However, the applicants have observed that the mass flow of the cryogen gas used as drive fluid can begin at 350 pounds per hour during the "pull-down" portion of the refrigeration cycle, but then level off to a rate of only 100 pounds per hour as the set point temperature for the system is approached. Presently, there is no known rotary vane motor that can efficiently convert energy from the expanding cryogen gas into rotary energy at slow rotational speeds and over such a broad range of cryogen mass flow rates. If the motor is large enough to efficiently convert such energy at a mass flow rate of 350 pounds per hour, then it will be grossly oversized for any such efficiency at a mass flow rate of 100 pounds per hour. On the other hand, if the motor is small enough for efficient operation at 100 pounds per hour, then the rpms will be too high when the mass flow rate increases to 350 pounds per hour.

The foregoing illustrates limitations known to exist in prior art rotary vane motors and methods. Thus it is apparent that it would be advantageous to provide a rotary vane motor that overcomes the limitations illustrated in the prior art. Accordingly, a suitable alternative is provided including features more fully disclosed hereinafter.

SUMMARY OF THE INVENTION

Generally speaking, the invention is a two-stage rotary vane motor that includes a housing enclosure, first and second rotors, and a shaft assembly for rotatably mounting the rotors in tandem within the housing enclosure. The shaft assembly is fixedly connected to the mechanical power output of the first rotor. The housing enclosure includes separate fluid chambers for enclosing each of the rotors, and each of the chambers includes a respective fluid inlet for receiving a pressurized drive fluid, which may be a cryogenic gas. The fluid inlet for supplying a volume of fluid to the first rotor chamber remains open during operation of the motor to permit fluid the pressurized drive fluid to be continuously supplied to the first rotor. A flow control valve is flow connected to the second inlet to the second fluid chamber. During operation of the motor of the present invention, the flow control valve is opened and closed as required to provide the required mass flow rate of pressurized drive fluid to the second fluid chamber.

In operation, when the mass flow rate of the pressurized driving cryogen is high for example 350 pounds per hour, both of the inlets of the housing enclosure are open to allow expanding cryogen to drive both of the rotors. However, when the mass flow rate of the cryogen is low, for example, 100 pounds per hour, the flow control valve is closed thereby suspending the flow of pressurized drive fluid to the second rotor. When the flow control valve is closed, drive fluid is supplied only to the first fluid chamber, therefore when the flow control valve is closed, the first rotor alone drives the shaft assembly. By altering the operation of the motor to single stage operation during operative periods where the flow rate of supplied drive fluid is relatively low, the two-stage rotary vane motor of the invention continues to efficiently convert the energy of expanding cryogen to rotary energy, and further drives the various components of a cryogenic refrigeration system (such as a blower and an alternator) at the required rotational speed.

In all the preferred embodiments of the invention, the body of the first rotor is fixedly connected to the shaft assembly so that the power output of the first rotor is always transmitted to an output end of the shaft assembly.

In a first embodiment of the invention, the rotor body of the second rotor is journaled around the shaft assembly and a clutch selectively connects and disconnects the second rotor body to and from the shaft assembly. The clutch is preferably an overrunning clutch that automatically disconnects the second rotor body from the shaft assembly when the pressurized fluid inlet of the second chamber is closed by the flow control valve.

In a second embodiment of the invention, both rotors are fixedly connected to the shaft assembly, and both are driven by pressurized cryogen when the mass flow rate of the cryogen is high. However, when the mass flow rate of the cryogen drops to a predetermined low level, the inlet to the second fluid chamber is closed by the flow control valve. When the flow control valve is closed, the second rotor does not contribute to the rotation of the shaft assembly. The first rotor alone drives the shaft assembly.

The axial lengths of the components of the rotor assemblies, including the rotor bodies and rotor vanes are different. For example, in the embodiments, the length of the body of the second rotor can be 150% greater than the length of the body of the first rotor so that the power generating capacity of the two rotors is substantially different. Such a design is particularly advantageous in an environment where the rate of mass flow of the expanding cryogen or other drive fluid is not distributed uniformly over a range, but instead assumes one of two substantially different flowrates (for example, from 100 pounds per hour to 350 pounds per hour). It should be understood that the axial lengths of the two rotors may be equal or substantially equal.

The foregoing and other aspects will become apparent from the following detailed description of the invention when considered in conjunction with the accompanying drawing figures.

BRIEF DESCRIPTION OF THE SEVERAL FIGURES

DETAILED DESCRIPTION OF THE PREFERRED EMBODIMENTS

The first embodiment two-stage rotary vane motor is illustrated in FIGS. 1, 2, 3, and 4. The first embodiment two-stage rotary vane motor 1 of the invention comprises discrete first and second tubular housing enclosures 5*a* and 5*b*, and a pair of opposing exterior first and second side plates 7*a* and 7*b*. The exterior side plates 7*a,b* are attached to their respective housing enclosures 5*a* and 5*b* by a plurality of bolts 9, and the desired fluid tight seal between the housing enclosures portions and side plates is formed by first and second conventional o-ring seals 209*a* and 209*b* located in grooves formed on the back of the side plates 7*a* and 7*b*. A pair of first and second interior side plates 10*a* and 10*b* are disposed between the housing enclosures 5*a* and 5*b* which in combination with first and second exterior plates 7*a* and 7*b* and housing enclosures 5*a* and 5*b* define a pair of side by side chambers 13*a* and 13*b*. The first chamber 13*a* is defined longitudinally by housing enclosure 5*a* and laterally by first exterior side plate 7*a* and first interior side plate 10*a*. The second chamber 13*b* is defined longitudinally by second housing enclosure 5*b* and laterally by second exterior side plate 7*b* and second interior side plate 10*b*.

A fluid tight seal is formed between first and second interior plates 10*a* and 10*b* by a conventional o-ring seal member 210 that is seated in an annular groove located on an exterior face of first interior plate 10*a*. Additionally, a fluid tight seal between plates 10*a,b* and adjacent housing enclosures 5*a* and 5*b* is formed by conventional first and second o-ring seals 208*a*, 208*b* that are located in grooves formed along the outer faces of first and second interior plates 10*a,b*.

Figure 1:
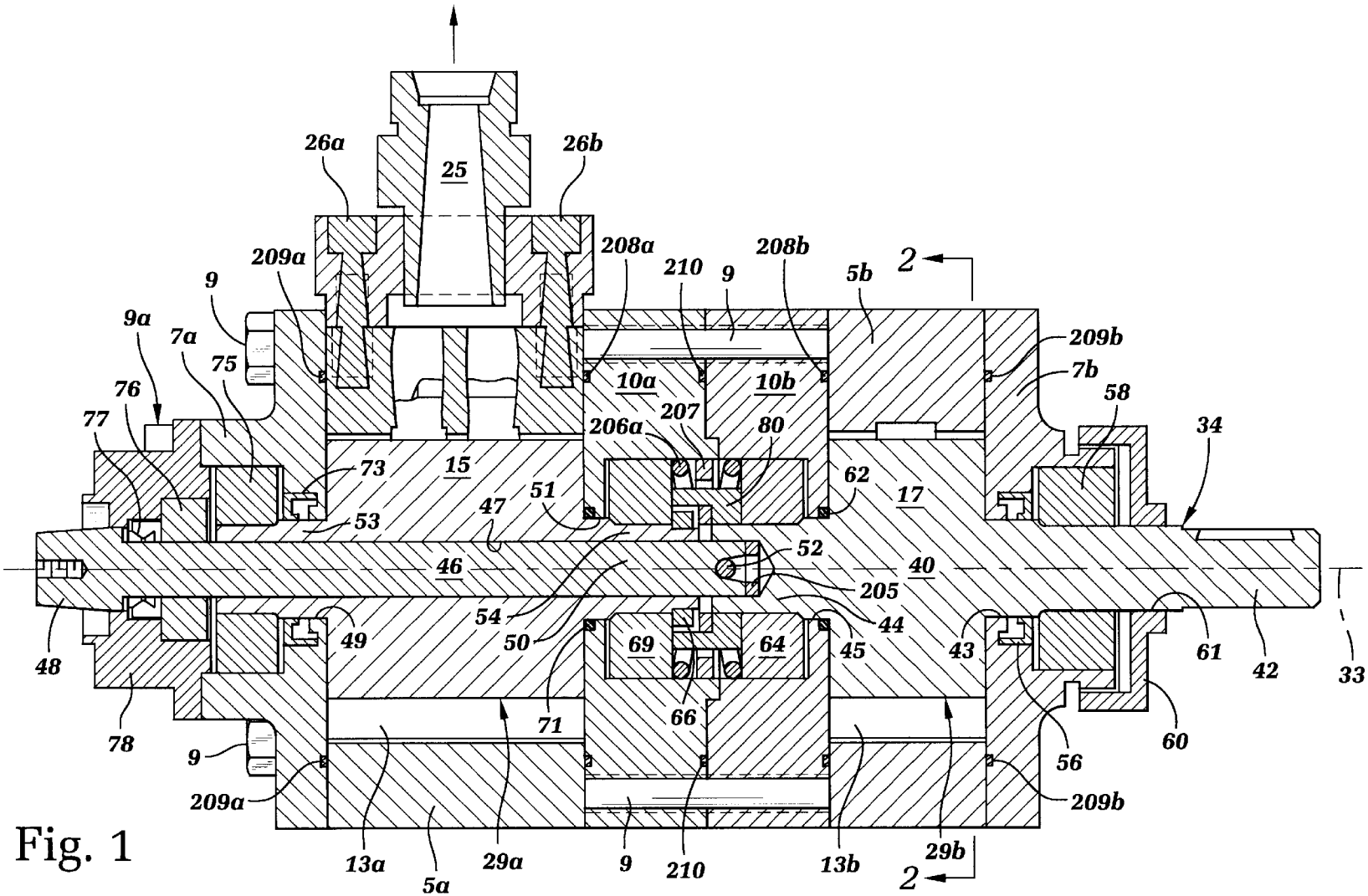
FIG. 1 is a longitudinal sectional view of a first embodiment of the two-stage rotary vane motor of the present invention.

Chambers 13*a* and 13*b* house first and second rotors 15 and 17, respectively. The rotors 15 and 17 rotate about axis 33. As shown in FIG. 1, second rotor 17 has a smaller axial dimension than first rotor 15. Therefore, as the description proceeds, rotor 17 may be referred to as either the smaller rotor or the second rotor, and rotor 15 may be referred to either as the larger rotor or the first rotor.

Figure 2:
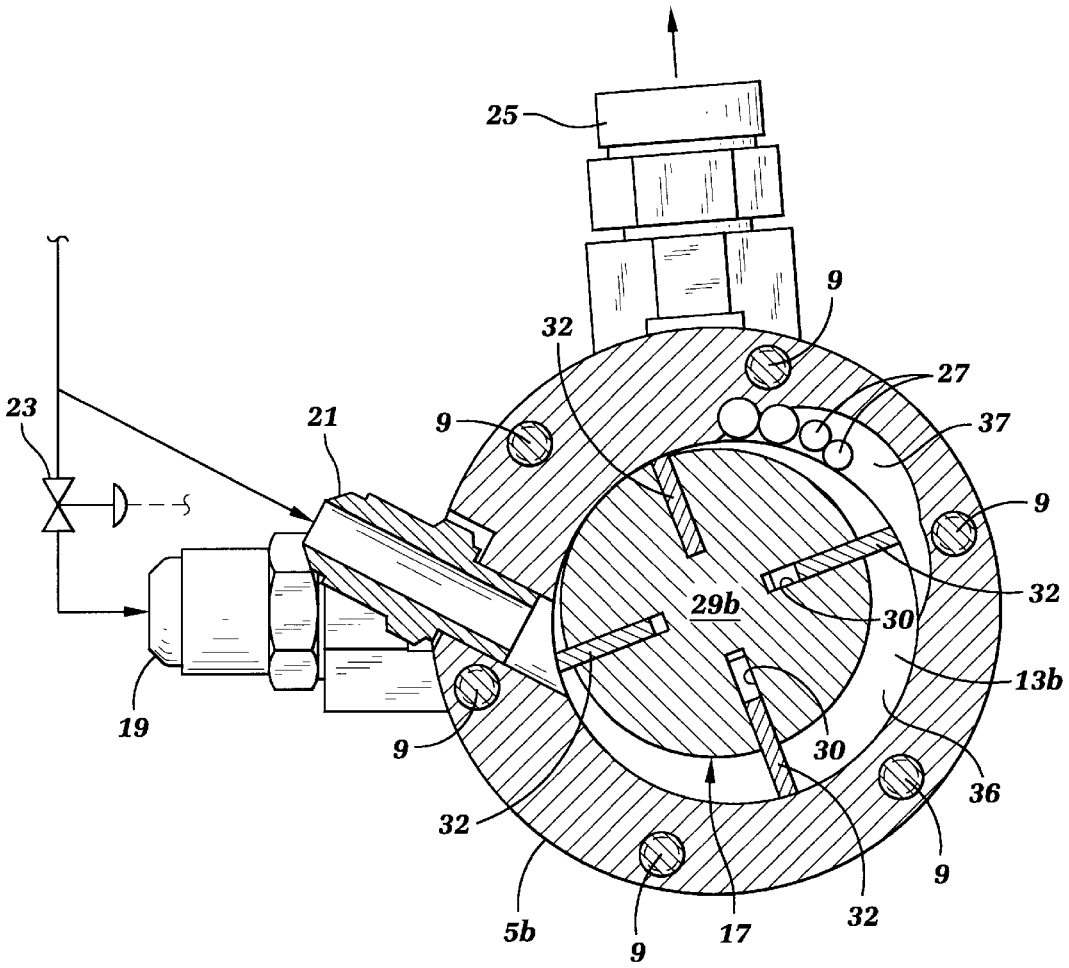
FIG. 2 is a transverse sectional view of the rotary vane motor illustrated in FIG. 1 taken along line 2—2.

Each of the two chambers 13*a* and 13*b* includes a pressurized fluid inlet, 19 and 21, respectively, which may receive pressurized gaseous cryogen. See FIG. 2. During operation of motor 1, the inlet 21 leading to the smaller of the two chambers 13*b* remains open for receiving such pressurized cryogen, however, a solenoid-operated valve 23 can selectively shut off pressurized cryogen supply to the larger of the two chambers 13*a*. The first housing enclosure 5*a* further includes a single pressurized fluid outlet 25 for expelling exhaust gases or other fluids used to drive the first and second rotors 15 and 17. Outlet 25 is secured onto the tubular housing enclosure 5*a* by means of mounting bolts 26*a,b*, as is shown in FIG. 1. As shown in FIG. 2, a plurality of gas-conducting bores 27 are provided through the interior side plates 10*a,b*. The purposes of these bores is to conduct exhaust gas from the smaller second chamber 13*b* to the larger first chamber 13*a* so that exhaust gases from both chambers 13*a,b* may be expelled through the single outlet 25.

With further reference to FIGS. 1 and 2, the first and second rotors 15 and 17 of the motor 1 include respective first and second bodies 29*a* and 29*b* having a plurality of radially-oriented slots 30 which are uniformly angularly spaced around the rotor bodies 29*a,b*. Rectangularly shaped vanes 32 (which are preferably formed form a self-lubricating plastic material, such as a polyamide are slidably disposed in each of the slots 30. While FIG. 2 shows only the slots and vanes of the rotor body 29*b* of the axially smaller rotor 17, the structure of the rotor body 29*a* of the larger rotor 15 is identical, with the exception that both the body 29*a* and vanes 32 are longer along the axis of rotation 33. See FIG. 3. While not specifically shown in any of the Figures, it is important to note that the vanes 32, and the rotors 15 and 17 and lengths of first and second rotor bodies 29*a*, 29*b* are dimensioned so that minimum clearance exists between the rotor vane lateral ends and the interior surfaces of the first and second exterior side plates 7*a* and 7*b*, and first and second interior side plates 10*a* and 10*b*, to minimize blow-by of pressurized gas between the side plates and the ends of the vane segments. In this way, the vanes 32 do not wipingly engage the inner surfaces of the exterior side plates 7*a,b* and interior side plates 10*a,b* but rather move past the inner surfaces of the plates 7*a,b* and 10*a,b*with a minimum clearance separating the rotors and inner surfaces of the plates to minimize leakage of pressurized gas or other mode of fluid in these areas. It should be understood that the first and second rotors and vanes may be identical and have the same axial dimension if required.

A shaft assembly 34 eccentrically mounts the rotor bodies 29*a,b* of each of the two rotors 15 and 17 within their respective chambers 13*a* and 13*b* so that a crescent-shaped space 36 (shown in FIG. 2) is present between one side of the rotors 15 and 17, and the inner, cylindrical walls of the chambers 13*a* and 13*b*. Such a crescent-shaped space allows pressurized cryogenic gas entering the housing enclosures 5*a* and 5*b* through the inlets 21 and 19 to commence expansion at the narrow, left hand side of the crescent-shaped space 36, and to continue such expansion as the rotor rotates counterclockwise until the gas reaches the upper, right-hand side of the space 36. At this point, the gas enters a plenum recess 37 (which is also present in chamber 13*a*, but not shown), whereupon it is ultimately discharged out through the outlet 25.

Figure 3:
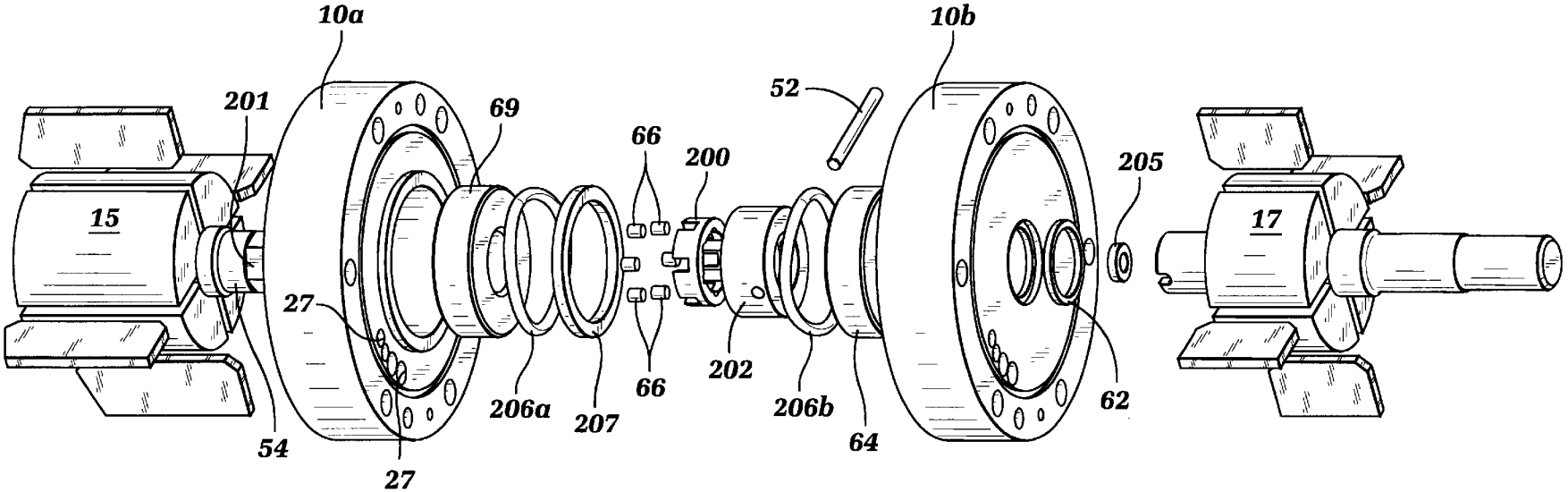
FIG. 3 is an exploded view of the rotors, clutch, and shaft assembly of the first embodiment two-stage rotary vane motor shown in FIG. 1.
Figure 4:
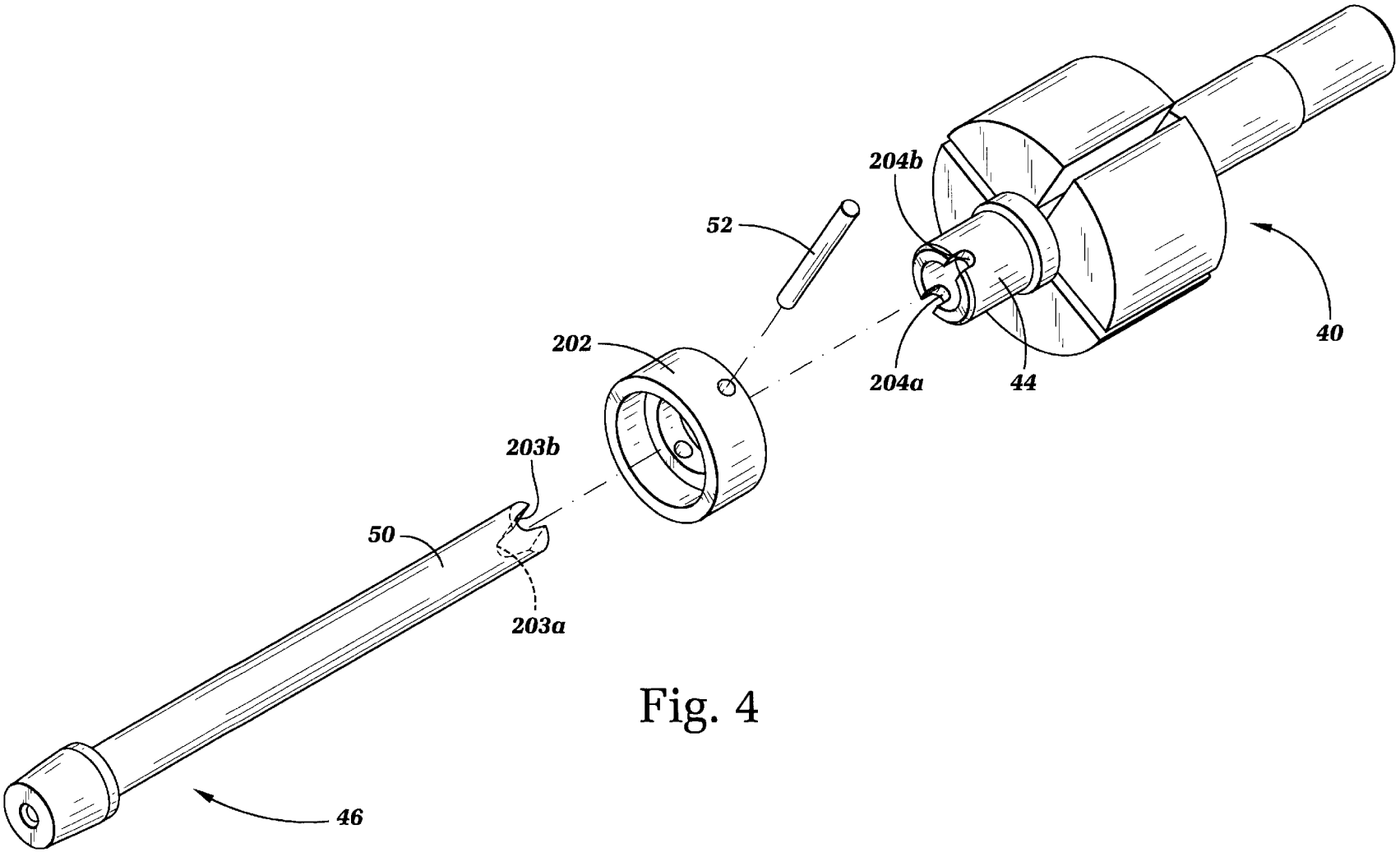
FIG. 4 is a detailed view of the rotor input shafts of the first embodiment two-stage rotary vane motor shown in FIG. 3.

With reference again to FIGS. 1 and 3, the shaft assembly 34 which rotatably mounts the rotors 15 and 17 in an in-tandem relationship within their respective chambers 13*a* and 13*b* is formed from a first rotor shaft 40 which is integrally connected to the cylindrical body 29*b* of the rotor 17. Shaft 40 includes an output end 42 that extends through a circular opening 43 in the exterior side plate 7*b*, as well as an input end 44 which is freely rotatable within a circular opening 45 in the interior side plate 10*b*. Shaft assembly 34 further includes a journaled rotor shaft 46 that slidably extends through a bore 47 that is concentrically aligned with the axis of rotation 33 of the rotor body 29*a* of rotor 15. Journaled shaft 46 likewise includes an output end 48 that extends through a circular opening 49 in the exterior end plate 7*a*, as well as an input end 50 which extends through another circular opening 51 in the interior side plate 10*a*. Turning to FIG. 4, a pair of opposed, open notches 203*a*, 203*b*, and 204*a*, 204*b* are provided at the input ends 50 and 44 of shafts 46 and 40 respectively. As shown in FIG. 4, the open u-shaped notches 203*a,b* and 204*a,b* are diametrically opposed and are aligned when shaft end 50 is inserted in end 44 in the manner shown in FIG. 1. The open notches enable shafts 44 and 50 to move along axis 33, and are still able to transmit torque via locking pin 52. The axial shaft movement is necessary to adjust the locations of rotors 15 and 17 in housing body 5, so that the proper clearances between rotors and plates 7*a,b* and 10*a,b* may be obtained.

As shown in FIG. 1, the input ends 44 and 50 of the shafts 40 and 46 are fixedly interconnected by means of a locking pin 52 that is passed through the aligned notches 203*a,b* and 204*a,b*, and the opening in the outer race 202 that surrounds the shaft ends.

Shaft 46 continuously transmits the power output of the larger rotor 15 to the smaller rotor 17 regardless of whether or not the power output of the larger rotor 15 is engaged to the shaft 40 via overrunning clutch 80 that will be described in detail below. Finally, the shaft assembly 34 includes a pair of shaft sleeves 53 and 54 which are directly journaled in the circular openings 49, 51 of the exterior and interior end plates 7*a*, 10*a*, respectively.

End cap 78 is secured to outer portion of exterior side plate 7*a* by a conventional bolt connection 90. The end cap 78, and bolt connection 90 serve to adjust the location of rotor 29*a* along axis 33 and in this way ensure that the required minimum clearances between the vane edges and the inner surfaces of interior plate 10*a* and exterior side plate 7*a* are achieved. Additionally, shims (not shown) may be wedged between the end cap and exterior side plate to position the rotor 29*a* for running clearance between the two side plates 7*a* and 10*a*. Springs 206*a* and 206*b* and spacer ring 207 sandwiched between the springs, are provided to eliminate axial play between the bearings 64, 69 and interior side plates 10*a* and 10*b* and also to take up end play for adjusting positions of rotors 15 and 17 within housing enclosures 5*a* and 5*b*.

The overrunning clutch assembly 80 is centrally disposed between bearings 69 and 64 and surrounds the junction of shafts 40 and 46 as shown in FIG. 1. Referring now to FIGS. 1 and 3, the clutch 80 is comprised of rollers 66 that are supported in a roller cage 200, inner race 201, and outer race 202. Inner race 201 is an extension of shaft sleeve 54. The locking pin is passed through the openings in the outer race 202 and notches 203, 204 in order to lock the shafts in place.

Overrunning clutch 80 engages the output of the rotor body 29*a* of the larger rotor 15 to the journaled shaft 40 only when the rotational speed of the rotor 15 is equal to the rotational speed of the smaller rotor 17. Essentially, clutch 80 permits transmission of rotary motive power in one direction only. The overrunning clutch is well known to those skilled in the related art and therefore further specific description of the details of the clutch is not required.

A number of fluid seals and bearing assemblies are provide on either side of both of the shafts 40, 46 and shaft sleeves 53, 54 to promote a gas-tight and substantially friction-free rotation of these components within the housing enclosure 3. With reference again to FIG. 1, a fluid seal 56 and ball bearing 58 are concentrically disposed around the output end 42 of the connected rotor shaft 40. An annular, end plate adjustment nut 60 having a circular opening 61 for receiving the output end 42 of the shaft 40 threadably engages an annular projection provided in the exterior side plate 7*b*. Nut 60 functions both to retain the various components of the motor within the housing enclosure 3, as well as to adjust the position of rotor 29*b* for running clearance between side plates 7*b* and interior plate 10*b*. A shaft seal 62 and another ball bearing 64 are concentrically arranged around the input end 44 of the rotor shaft 40 as shown, so that the cylindrical body 29*b* of the rotor 17 can freely rotate within its respective chamber 13*b* without the loss of significant amounts of pressurized motor fluid.

A shaft seal 71 prevents pressurized motor gas or other fluid form escaping out of the circular opening 51 in the inner side plate 10*a*. Turning now to the outer shaft sleeve 53, this component is concentrically surrounded by a shaft seal 73, and a ball bearing 75. Another ball bearing 76 is provided within an annular recess in retaining end cap 78 for rotatably mounting the output end 48 of the journaled rotor shaft 46. Finally, a dust seal 77 is provided in another annular recess within the end cap 78 for preventing pressurized drive gas or other fluid form escaping from the chamber 13*a* out through the exterior sidewall 7*a* of the housing enclosure 3.

In operation, when the mass flow of the cryogenic drive fluid is high (on the order of 350 pounds per hour), valve 23 is opened so as to permit the admission of drive fluid through both of the inlets 19 and 21. The internal diameter of the apertures defined by the inlets 21 and 19 are dimensioned so that, an adequate amount of cryogen drive fluid is supplied to each chamber 13*a* and 13*b* so that the rotational speed of the larger rotor 15 is at least as high as the rotational speed of the smaller rotor 17. Under such circumstances, the overrunning clutch engages the output of the cylindrical body 29*a* of the rotor 15 to the output ends 42 and 48 of the shaft assembly 34. However, when the mass flow of the drive fluid drops below a certain level (i.e., on the order of 100 pounds per hour), valve 23 is closed and cryogen drive fluid is now supplied to the smaller chamber 13*b* only. Without a supply of cryogen drive fluid, the rotational speed of the larger rotor 15 is reduced causing a disparity in rotational speeds of rotors 15 and 17. The disparity in rotational speeds between 15 and 17 causes the overrunning clutch 80 to disengage the cylindrical body 29*a* of the rotor 15 from the journaled shaft 40 resulting in only the smaller rotor 17 generating motive power while rotor 15 idles. The previously-described mechanical action allows the output ends 34 and 48 of the motor 1 to rotate at a speed commensurate with efficient mechanical conversion of gas pressure to mechanical energy over a broad range of motive fluid gas flow.

Figure 5:
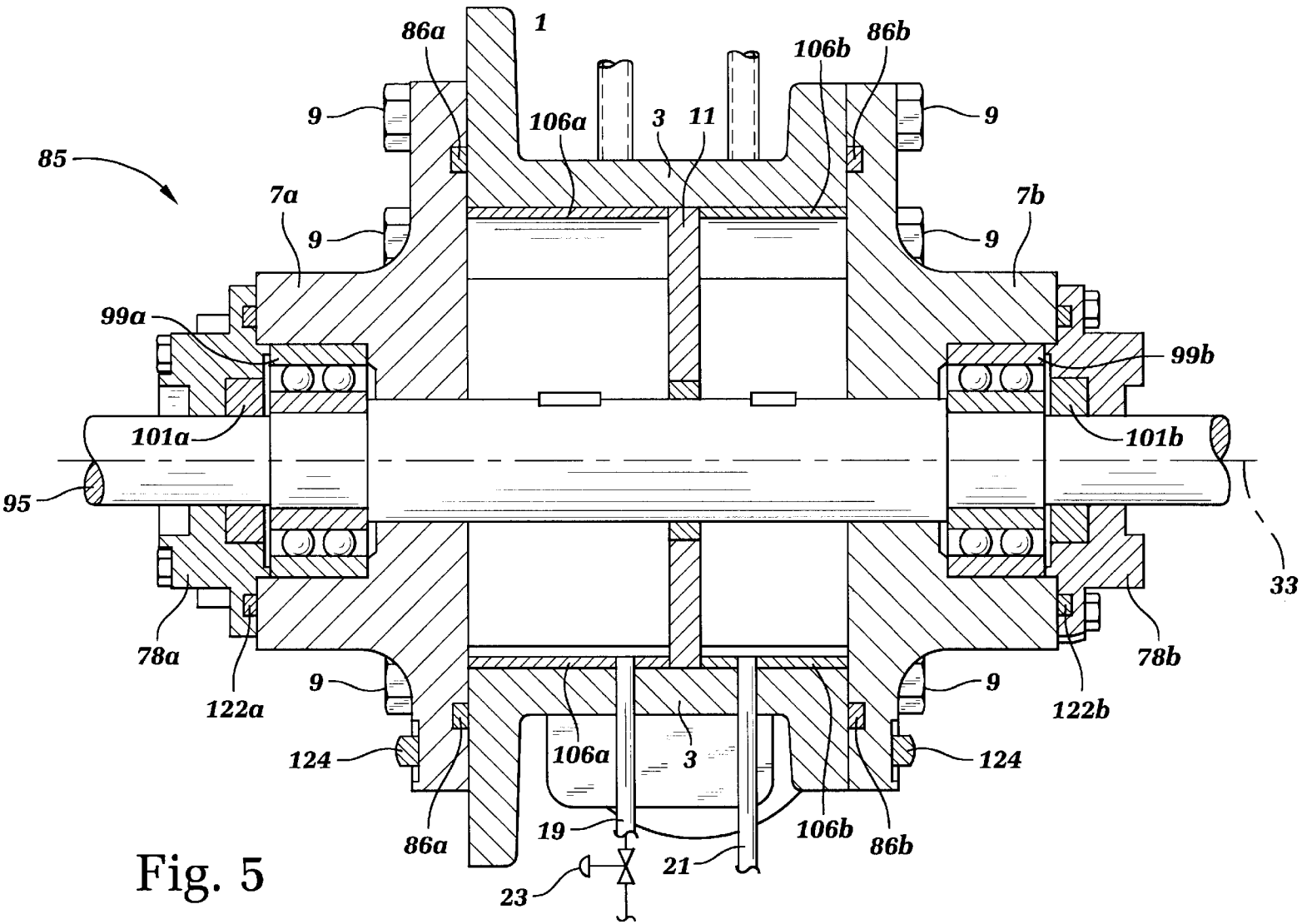
FIG. 5 is a longitudinal sectional view of a second embodiment of the two-stage rotary vane motor of the invention.

FIG. 5 illustrates a second embodiment of the two-stage rotary vane motor 85 of the present invention. Motor 85 includes a unitary tubular housing enclosure 3. Exterior side plates 7*a,b* a resecured on opposing ends of the housing enclosure by conventional bolts 9. O-rings 86*a,b* disposed in opposing annular grooves are located between the side plates 7*a,b* and the ends of the housing enclosure 3 in order to effect a fluid-tight seal. Sealing O-rings l22*a*, b are disposed in annular grooves located between side plates 7*a,b* and retaining end caps 78*a,b*. Retaining end caps 78*a,b* are bolted or otherwise conventionally connected to side plates 7*a,b*. Alignment pins 124 in side plates 7*a,b* can serve to aid in assembly of motor 85.

A single, internal partition or sidewall 11 is supported by the housing 3 between the enclosure ends and divides the interior of the tubular housing enclosure 3 into discrete fluid chambers 13*a,b*. The partition serves to form one side of chambers 13*a*, 13*b* like interior side plates 10*a*, 10*b* of the first preferred embodiment of the invention. For purposes of disclosing the second preferred embodiment of the invention, the partition is a substantially solid, disk-shaped member with a central opening 105. As illustrated in FIG. 5, fluid seal 104 is seated in the partition opening 105. The partition is located along the length of shaft 93 between rotors 87 and 89, and thereby defines one side of chambers 13*a* and 13*b*. The chambers 13*a,b* are further defined by side plates 7*a* and 7*b* and annular shells 106*a* and 106*b* that are sandwiched between the side plates and partition. The fluid seal 104 fluidly isolates the two discrete fluid chambers 13*a,b*.

Rotors 87,89, each of which includes a cylindrical rotor body 88,90, are separately disposed within respective discrete fluid chambers 13*a,b*. Like rotors 15 and 17, described in conjunction with the first embodiment of the invention, first rotor body 88 has a greater axial dimension than second rotor body 90 and therefore, rotor body 90 may be referred to as the description proceeds, as the smaller rotor or first, and rotor body 88 may be referred to as the larger rotor or second rotor. Additionally, the rotors 87, 89 may be the same. Each of the rotor bodies 88, 90 is affixed to the shaft assembly 93 for rotation therewith, by means of a key 91*a,b*, respectively. Rotors 87, 89 are, however, free to slide axially along axis 33 of shaft 93.

As previously described in the description of the first embodiment of the present invention two-stage rotary vane motor, the shaft assembly 93 rotatably mounts the cylindrical rotor bodies 88,90 of the rotors 87,89 in an eccentric relationship within each of the separate fluid chambers 13*a,b*. Each of the rotor bodies 88,90 also includes radially oriented slots for housing slidably mounted vanes (not shown) which operate in precisely the same fashion as the vanes 32 associated with the first embodiment motor 1. As shown in FIG. 5, the larger rotor 87 is located in chamber 13*a* and the smaller rotor 89 is located in chamber 13*b*. The larger rotor may have an axial length that is 1.5 times the axial length of smaller rotor 89.

The shaft assembly 93 includes a pair of opposing output ends 95*a,b*. Each of the ends 95*a,b* is circumscribed by a ball bearing 99*a,b*, and a fluid seal 101*a,b*. The bearings 99*a,b* reduce friction between the shaft 93 and the openings in the side plate 7*a,b* through which the output ends are journaled, while the seals 101*a,b* prevent pressurized drive fluid from leaking out through the side plates 7*a,b*.

In contrast to the first described embodiment, the second embodiment 85 includes a pair of removable annular shells 106*a,b* which circumscribe the inner diameter of the tubular housing enclosure 3. These annular shells 106*a,b* serve as the sealing surfaces which the upper ends of the vanes (not shown in FIG. 5) are moved past closely proximate the annular shells when the motor 85 is in operation. Annular shells 106*a*, 106*b* and the partition 11 are prevented from rotating by securing the annular shells and partition 11 to housing enclosure 3 by suitable means such as conventional keys or pins (not shown). However, the annular shells 106*a,b* may be formed from an alloy that is more easily machined to a very smooth finish than housing enclosure 3 (thereby enhancing the sealing action between the closely adjacent vanes and the inner surface of the housing enclosure 3), and may be easily removed when worn for either replacement or refinishing.

In an alternate embodiment of motor 85, the partition 11 may be made integral with housing enclosure 3. This alternate embodiment motor may or may not use the concept of annular shells 106*a*, 106*b*.

A further difference between the second embodiment 85 and the first described embodiment is the fact that each of the two fluid chambers 13*a,b* within the housing enclosure 3 has its own gas outlet 108,110 respectively. Such separation of the outlets 108, 110 ensures that spent drive fluid exiting the chamber 13*b* through outlet 110 will not leak into the chamber 13*a* when chamber 13*a* and its associated rotor 87, are taken out of operation by fluid valve 23 in the manner described hereinafter.

Operation of second embodiment motor 85 will now be described. In operation, when the mass flow rate of the drive fluid is high, both of the fluid inlets 19, 21 are opened so that the drive fluid can react against the vanes 32 of the two rotors 87, 89. However, when the cryogen mass flow rate is low, valve 23 is closed, thereby preventing the entry of drive fluid into the chamber 13*a*. Accordingly, fluid is admitted only through inlet 21 into the chamber 13*b*, and the shaft assembly 93 is driven solely by the second, smaller rotor 89. While this embodiment has the disadvantage that the rotation of the shaft assembly 93 will be somewhat encumbered by the "idling" body 88 of the rotor 87 when the valve 23 is closed, the amount of rotational inertia associated with the larger, first rotor 87 is not substantial.

Figure 6:
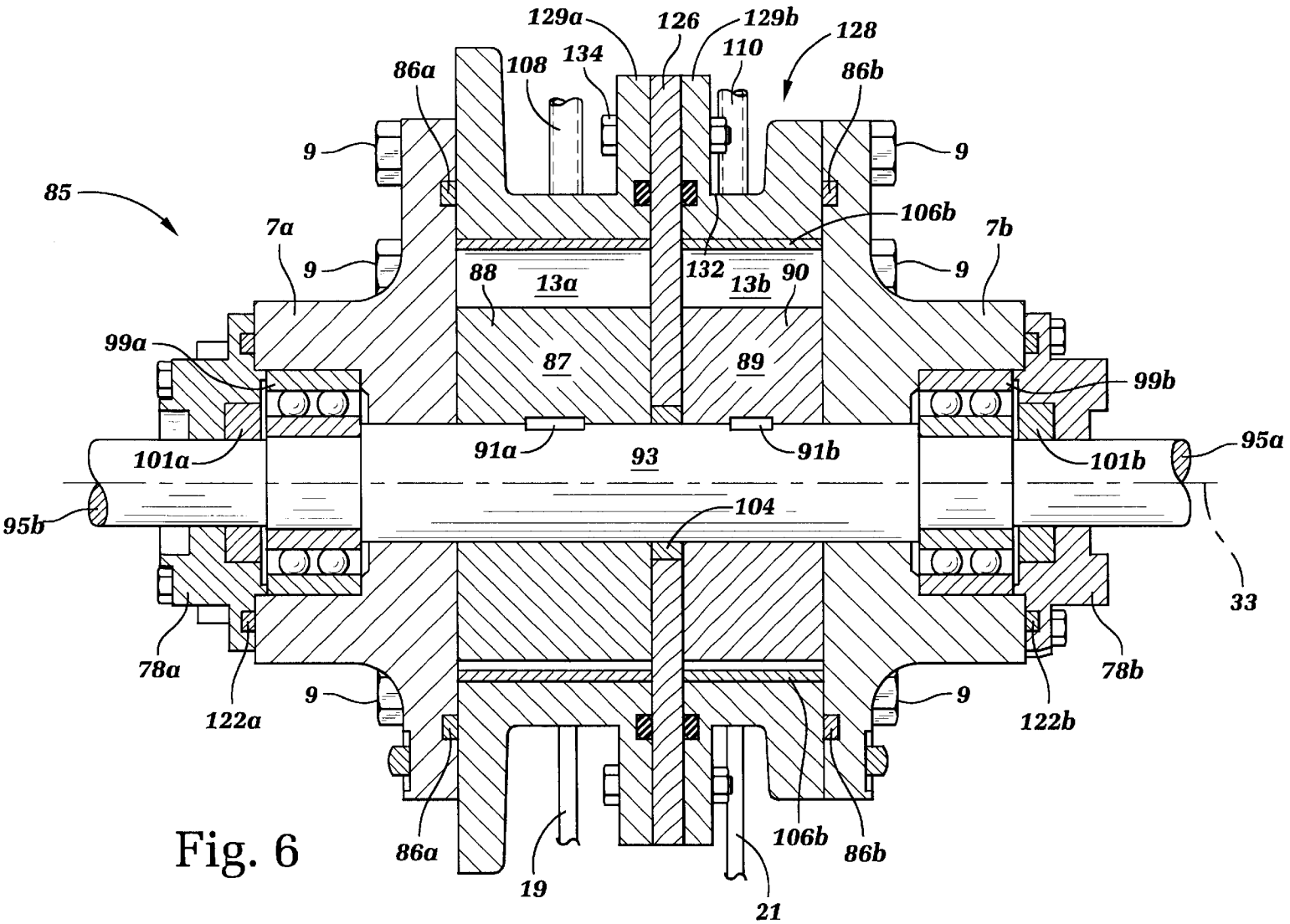
FIG. 6 is a longitudinal sectional view of a third embodiment of the two-stage rotary vane motor of the invention.

With reference now to FIG. 6, another embodiment of the invention is illustrated in a motor 185. Two-stage rotary vane motor 185 is a variation of motor 85 of FIG. 5. The motors 85 and 185 are the same except for the following difference. Unlike motor 85, Motor 185 includes a two-piece tubular housing enclosure 128, comprised of a first housing enclosure portion 129*a* and a second housing enclosure portion 129*b*. An internal sidewall or partition 126 is disposed between the first and second housing enclosure portions. The partition 126 includes a central opening 105 that supports a fluid seal 104. First and second housing enclosure portions 129*a* and 129*b* and partition 126 are fastened together by conventional bolts 134. In the embodiment illustrated in FIG. 6, partition 126 extends radially outward from shaft assembly 93 sufficiently far so as to be flush with the outer surface of tubular body portion 128. Since partition 126 does not terminate within the tubular body portion, sealing o-rings 132 serve to seal the interface between tubular housing portion 129*a* and the partition 126. Again, annular shells 106*a,b* may or may not be employed.

The motor 185 operates in the same manner as motor 85 and motor 1.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A method of operating a two-stage rotary vane motor that includes and housing enclosure having first and second chambers, and first and second inlets for admitting pressurized fluid to said first and second chambers, respectively; first and second rotors disposed within said first and second chambers of said housing enclosure, respectively, each of which includes a cylindrical rotor body having a plurality of radially oriented slots, and a plurality of vanes slidably movable within said slots, a shaft means for rotatably mounting said rotors in tandem within said first and second chambers of said housing enclosure, said shaft means being connected to said second rotor and having an output end for continuously transmitting said power, the method comprising the steps of:

admitting pressurized fluid through said first and second inlets when a mass flow rate of said pressurized fluid is above a first predetermined value, and closing said first inlet to said first chamber when the mass flow rate of said pressurized fluid falls below a second predetermined value.

* * * * *